US005845892A

United States Patent [19]

Lee

[11] Patent Number: 5,845,892

[45] Date of Patent: Dec. 8, 1998

[54] PUSHING APPARATUS FOR PUSHING A WALL FORM ASSEMBLY

[76] Inventor: Kou-An Lee, No. 851, Chung-Shan Rd., Nan-Shing Tsun, Kui-Jen Hsiang, Tainan Hsien, Taiwan

[21] Appl. No.: 890,806

[22] Filed: Jul. 11, 1997

[51] Int. Cl.[6] ..... B66F 3/36

[52] U.S. Cl. ..... 254/100

[58] Field of Search ..... 254/100, 89 R, 254/DIG. 1, 420, 133 R, 7 R, 98, 134

[56] References Cited

U.S. PATENT DOCUMENTS

| | | | |
|---|---|---|---|
| 2,503,388 | 4/1950 | Hedlund | 414/10 |
| 5,544,852 | 8/1996 | Lee . | |

FOREIGN PATENT DOCUMENTS

| | | | |
|---|---|---|---|
| 651338 | 1/1964 | Belgium | 52/127.2 |
| 406185218 | 7/1994 | Japan . | |
| 6-185218 | 7/1994 | Japan | 52/127.2 |

*Primary Examiner*—Timothy V. Eley
*Assistant Examiner*—Benjamin M. Halpern
*Attorney, Agent, or Firm*—Merchant, Gould, Smith, Edell, Welter & Schmidt

[57] ABSTRACT

A pushing apparatus for pushing a wall form assembly that is provided with roller assemblies includes an upright tubular seat that confines an axial hole therethrough. A rotary shaft is disposed rotatably in the axial hole and has a lower end that extends out of the tubular seat and that has a base plate mounted securely thereon. A foot unit includes a pivot plate disposed below and mounted pivotally to the base plate, and an inclined support which inclines downwardly from the pivot plate and which has a lower end portion that contacts the floor. The foot unit further includes a spring member interposed between the base plate and the inclined support. The operating member includes a threaded shank which extends threadedly into the axial hole via the internally threaded top section and which is coupled rotatably to an upper end of the shaft. When the threaded shank is rotated so as to extend a longer length of the shaft out of the tubular seat, the foot unit is forced toward the floor against action of the spring member and pivots so as to generate a pushing force that is applied by the tubular seat on the wall form assembly to facilitate adjustment of the position of the wall form assembly on the floor.

3 Claims, 7 Drawing Sheets

PUSHING APPARATUS FOR PUSHING A WALL FORM ASSEMBLY

BACKGROUND OF THE INVENTION

1. Field of the Invention

The present invention relates to a pushing apparatus for pushing a wall form assembly that is provided with roller assemblies when moving the wall form assembly on a floor of a concrete structure.

2. Description of the Related Art

Modular wall form assemblies which permit high-quality construction of concrete partition walls have grown in popularity in recent years. When constructing partition walls on a floor of a concrete structure, the modular wall form assemblies are assembled into a number of multi-sided units which are subsequently hoisted to predetermined positions on the floor. Concrete is then poured into pouring spaces defined between adjacent ones of the wall form assemblies, thereby forming the concrete partition walls when the concrete hardens.

A conventional modular wall form assembly, such as that disclosed in U.S. Pat. No. 5,544,852, for forming a concrete partition wall is shown in FIG. 1. The wall form assembly 1 includes four vertical wall form panels 11 which cooperatively confine a rectangular space, and a plurality of horizontal reinforcement units 12 mounted on inner sides of the vertical wall form panels 11. Referring to FIG. 2, each of the vertical wall form panels 11 includes a plurality of channel pieces 13 coupled detachably side by side to one another. Each of the channel pieces 13 includes two opposing vertical webs 131 and an intermediate form wall 132 which interconnects the vertical webs 131. Each of the horizontal reinforcement units 12 includes a plurality of reinforcement members 14 interconnected detachably to each other.

In order for the wall form assembly 1 to be reusable and to be capable of forming high-quality concrete walls, both the channel pieces 13 and the reinforcement members 14 are made of metal, such as steel. Thus, the wall form assembly 1 is relatively heavy and is difficult to move when adjusting the position thereof on the floor. In a co-pending application by the applicant, it is proposed that roller assemblies be provided on the reinforcement members 14 to facilitate movement of the wall form assembly 1. However, the moving direction of the wall form assembly 1 cannot be well controlled by mere provision of the roller assemblies. As such, there is a need to provide a pushing apparatus for pushing the aforementioned wall form assembly 1 when moving the latter on the floor.

SUMMARY OF THE INVENTION

The main object of the present invention is to provide a pushing apparatus which has a relatively simple structure, which occupies a relatively small amount of space, and which can be used for pushing a wall form assembly having roller assemblies mounted thereon when moving the wall form assembly on a floor of a concrete structure.

Accordingly, the pushing apparatus of the present invention is used for pushing a wall form assembly when the wall form assembly is moved on a floor of a concrete structure. The wall form assembly includes a plurality of vertical channel pieces coupled detachably side by side to one another, and a plurality of horizontal reinforcement members interconnected detachably to each other. Each of the reinforcement members has opposite top and bottom sides, a mounting side which is mounted detachably on the vertical channel pieces, and a free side opposite to the mounting side. The wall form assembly further includes a plurality of roller assemblies mounted on the reinforcement members to facilitate adjustment of a position of the wall form assembly on the floor. The pushing apparatus comprises an upright tubular seat, a rotary shaft, a foot unit and an operating member. The upright tubular seat is adapted to be disposed beside the free side of one of the reinforcement members. The tubular seat has upper and lower portions, and confines an axial hole through the upper and lower portions. The upper portion has an internally threaded top section and is provided with an upper clamping plate. The lower portion is provided with a lower clamping plate. The upper and lower clamping plates are adapted to abut respectively against the top and bottom sides of said one of the reinforcement members so as to clamp cooperatively said one of the reinforcement members at the free side thereof. The rotary shaft is disposed rotatably in the axial hole of the tubular seat. The shaft has an upper end and a lower end that extends out of the tubular seat and that has a base plate mounted securely thereon. The base plate has a first portion adjacent to the lower clamping plate and a second portion opposite to the first portion. The foot unit includes a generally horizontal pivot plate disposed below and mounted pivotally to the base plate about a horizontal axis. The pivot plate has a first section adjacent to the first portion of the base plate and a second section opposite to the first section. The foot unit further includes an inclined support which inclines downwardly from the second section of the pivot plate in a direction away from the first section of the pivot plate. The inclined support has a lower end portion that is adapted to contact the floor of the concrete structure. The foot unit further includes a spring member interposed between the second portion of the base plate and the inclined support. The operating member includes a threaded shank which has a lower section that extends threadedly into the axial hole of the tubular seat via the internally threaded top section of the upper portion and that is coupled rotatably to the upper end of the shaft. When the threaded shank is rotated so as to extend a longer length of the shaft out of the tubular seat, the foot unit is forced toward the floor against action of the spring member and pivots so as to generate a pushing force that is applied by the tubular seat on said one of the reinforcing members to facilitate adjustment of the position of the wall form assembly on the floor.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
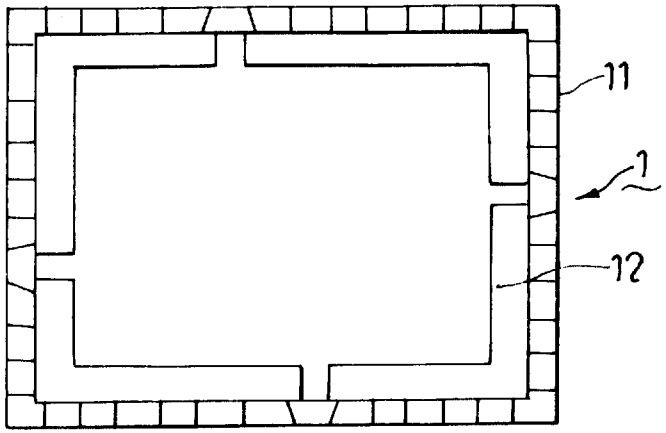
FIG. 1 PRIOR ART
FIG. 1 is a top view of a conventional modular wall form assembly.
Figure 2:
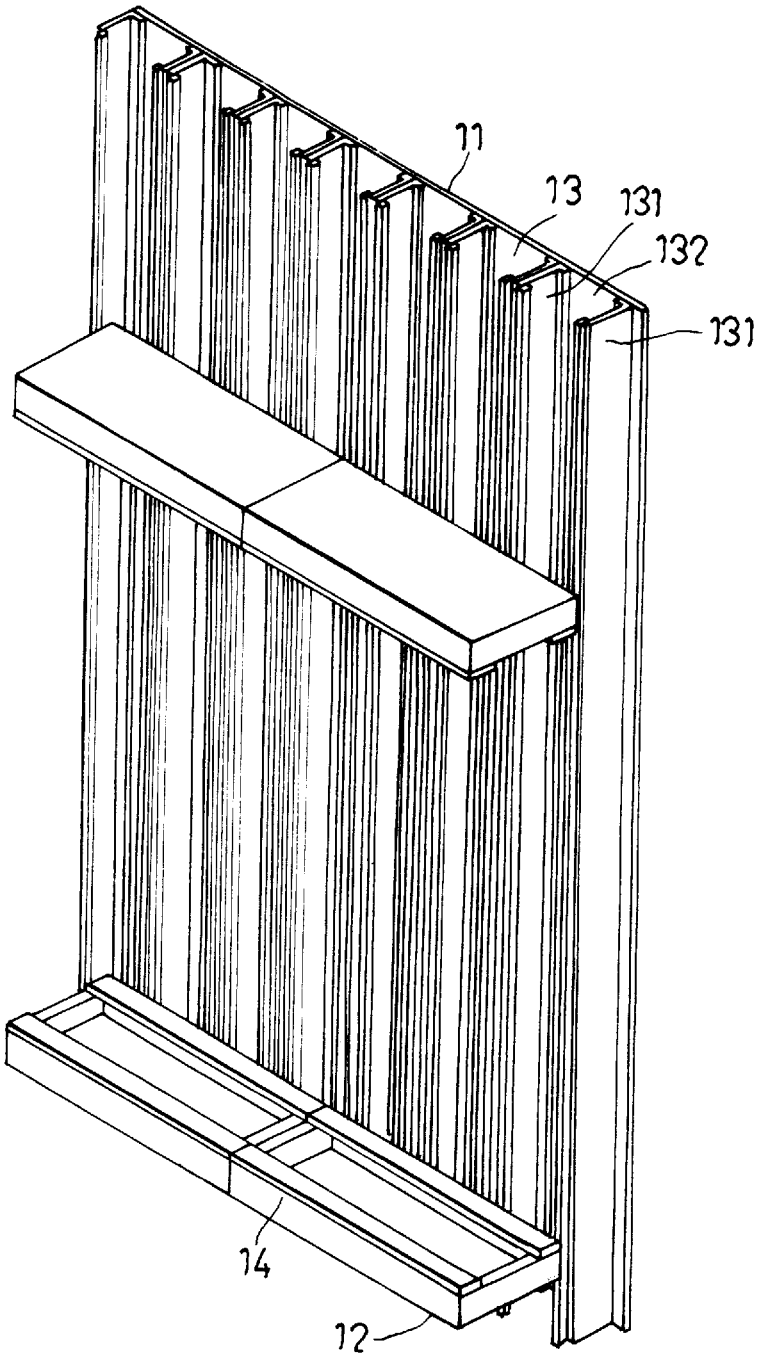
FIG. 2 PRIOR ART
FIG. 2 is a perspective view illustrating vertical channel pieces and reinforcement members of the conventional modular wall form assembly.

The pushing apparatus of the present embodiment is used for pushing a conventional modular wall form assembly 1 similar to that shown in FIGS. 1 and 2 when moving the conventional wall form assembly 1 on a floor of a concrete structure. The conventional wall form assembly 1 includes a plurality of vertical channel pieces 13 and a plurality of horizontal reinforcement members 14. Each of the channel pieces 13 includes two opposing vertical webs 131 and an intermediate form wall 132 which interconnects the vertical webs 131. Each of the horizontal reinforcement members 14 has opposite top and bottom sides 141, 142, a mounting side 143 which is mounted detachably on the vertical webs 131, and a free side 144 opposite to the mounting side 143. The wall form assembly 1 further includes a plurality of roller assemblies 2 mounted on the reinforcement members 14 to facilitate adjustment of a position of the wall form assembly 1 on the floor.

Figure 3:
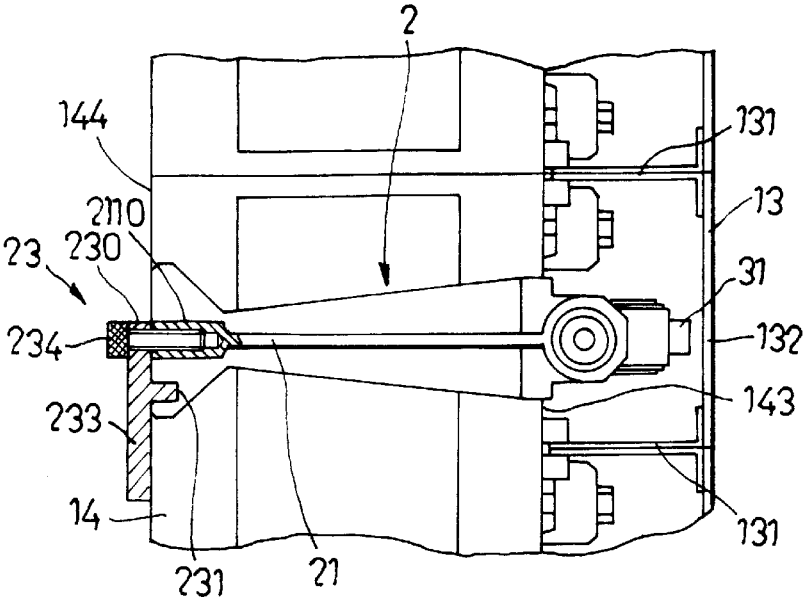
FIG. 3 is a top view illustrating a roller assembly mounted on a reinforcement member of the conventional modular wall form assembly.
Figure 4:
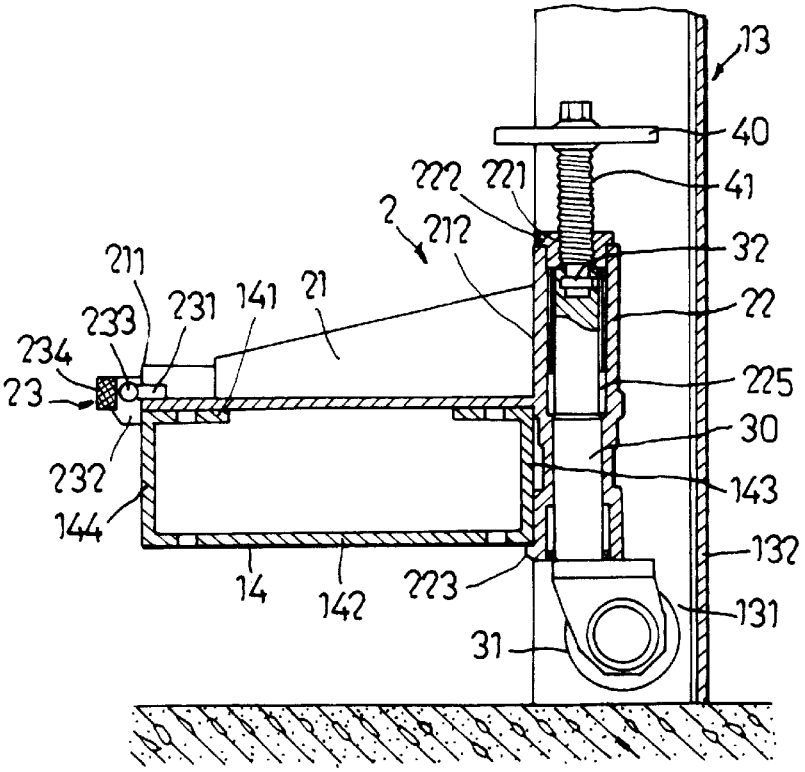
FIG. 4 is a vertical sectional view of the roller assembly of FIG. 3.
Figure 5:
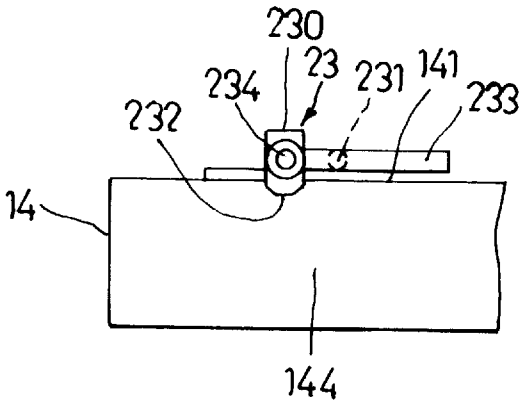
FIG. 5 is a front view illustrating a hook member of the roller assembly of FIG. 3.

Referring to FIGS. 3 to 5, each of the roller assemblies 2 is shown to comprise an upright tubular seat 22, a horizontal beam 21, a hook member 23, a rotary shaft 30 and an operating member 40.

The upright tubular seat 22 is disposed between the vertical webs 131 of one of the channel pieces 13 and between the mounting side 143 of one of the reinforcement member 14 and the form wall 132 of said one of the channel pieces 13. The tubular seat 22 has upper and lower portions and confines an axial hole 225 through the upper and lower portions. The upper portion of the tubular seat 22 is provided with an internally threaded sleeve 222 that is mounted on a top end of the tubular seat 22 and that confines a threaded hole 221 aligned with the axial hole 225 of the tubular seat 22. The lower portion of the tubular seat 22 is provided with a radial support projection 223 to support the bottom side 142 of said one of the reinforcement members 14 adjacent to the mounting side 143 thereof.

The horizontal beam 21 has a substantially inverted T-shaped configuration, a front end 211 formed with a screw socket 2110, and a rear end 212 mounted securely on the upper portion of the tubular seat 22. The horizontal beam 21 is straddled across the top side 141 of said one of the reinforcement members 14 in a direction from the mounting side 143 to the free side 144. The horizontal beam 21 and the support projection 223 of the tubular seat 22 clamp cooperatively said one of the reinforcement members 14 at the mounting side 143 thereof.

The hook member 23 includes a mounting portion 230 mounted removably on the front end 211 of the horizontal beam 21 by means of a screw fastener 234 which engages the screw socket 2110, a downward extension 232 which extends from the mounting portion 230 and which presses against the free side 144 of said one of the reinforcement members 14, a horizontal extension 233 which extends from the mounting portion 230, and a transverse projection 231 which is formed on the horizontal extension 233 and which presses the horizontal beam 21 against the top side 141 of said one of the reinforcement members 14.

The rotary shaft 30 is disposed rotatably in the axial hole 225 of the tubular seat 22. The rotary shaft 30 has an upper end formed with a blind coupling hole 32 and a lower end that extends out of the tubular seat 22 and that has a roller 31 mounted thereon. The roller 31 is in rolling contact with the floor of the concrete structure.

The operating member 40 includes a threaded shank 41 which has a lower section that extends threadedly into the axial hole 225 of the tubular seat 22 via the internally threaded sleeve 222. The lower section of the threaded shank 41 extends into the coupling hole 32 in the upper end of the rotary shaft 30 and is coupled rotatably to the upper end of the shaft 30.

The assembly 2 is mounted on the conventional wall form assembly 1 in such a manner that the tubular seat 22 is disposed between the vertical webs 131 of one of the channel pieces 13 and between the mounting side 143 of one of the reinforcement members 14 and the form wall 132 of said one of the channel pieces 13 (see FIG. 3), that the horizontal beam 21 rests on and straddles across the top side 141 of said one of the reinforcement members 14, and that the support projection 223 supports the bottom side 142 of said one of the reinforcement members 14 (see FIG. 4). The hook member 23 is then mounted as shown in FIG. 5 to press against the free side 144 and against the top side 141 of said one of the reinforcement members 14. After the assembly 2 has been mounted stably on said one of the reinforcement members 14, the operating member 40 is operated. Since the lower section of the operating member 40 is coupled to the upper end of the shaft 30, and since the roller 31 is in contact with the floor, rotation of the operating member 40 can result in upward movement of the tubular seat 2 relative to the rotary shaft 3, thereby raising the wall form assembly 1 together with the tubular seat 22 relative to the floor of the concrete structure. The wall form assembly 1 can thus be moved on the floor with the assistance of the roller 31, which significantly reduces the friction between the wall form assembly 1 and the floor to facilitate movement of the wall form assembly 1.

Figure 6:
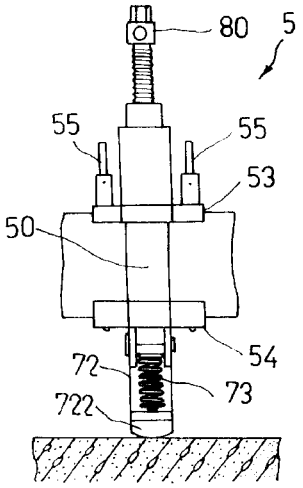
FIG. 6 is a schematic view of the pushing apparatus according to a preferred embodiment of the present invention.
Figure 7:
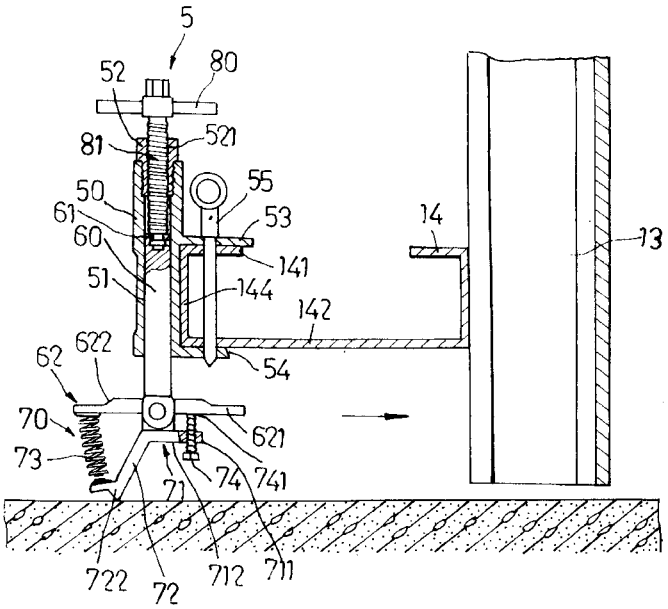
FIG. 7 is a vertical sectional view of the pushing apparatus according to the preferred embodiment.
Figure 8:
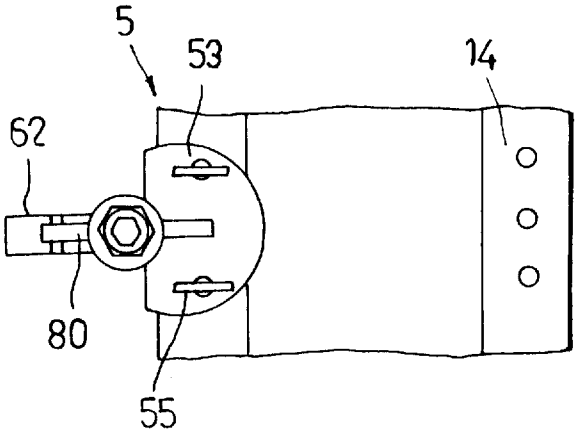
FIG. 8 is a top view of the pushing apparatus according to the preferred embodiment.

Referring to FIGS. 6 to 8, the pushing apparatus 5 of the present embodiment is shown to include an upright tubular seat 50, a rotary shaft 60, a foot unit 70 and an operating member 80.

The upright tubular seat 50 is adapted to be disposed beside the free side 144 of one of the reinforcement members 14. The tubular seat 50 has upper and lower portions and confines an axial hole 51 through the upper and lower portions. The upper portion of the tubular seat 50 is provided with an internally threaded sleeve 52 that is mounted on a top end of the tubular seat 50 and that confines a threaded hole 521 aligned with the axial hole 51 of the tubular seat 50. The upper portion of the tubular seat 50 is further provided with a horizontal upper clamping plate 53. The lower portion is provided with a lower clamping plate 54 parallel to the upper clamping plate 53. The upper and lower clamping plates 53, 54 are adapted to abut against the top and bottom sides 141, 142 of said one of the reinforcement members 14 so as to clamp cooperatively said one of the reinforcement members 14 at the free side 144 thereof. A fastening pin 55 extends removably through the upper and lower clamping plates 53, 54 and said one of the reinforcement members 14 for securing removably said one of the reinforcement members 14 on the tubular seat 50.

The rotary shaft 60 is disposed rotatably in the axial hole 51 of the tubular seat 50. The shaft 60 has an upper end formed with a blind coupling hole 61 and a lower end that extends out of the tubular seat 50 and that has a horizontal base plate 62 mounted securely thereon. The base plate 62 has a first portion 621 disposed under and adjacent to the lower clamping plate 54, and a second portion 622 opposite to the first portion 621.

The foot unit 70 includes a generally horizontal pivot plate 71 disposed below and mounted pivotally to the base plate 62 about a horizontal axis. The pivot plate 71 has a first section 711 adjacent to the first portion 621 of the base plate 62, and a second section 712 opposite to the first section 711. The foot unit 70 further includes an inclined support 72 which is formed integrally on the pivot plate 71 and which inclines downwardly from the second section 712 of the pivot plate 71 in a direction away from the first section 711 of the pivot plate 71. The inclined support 72 has a pointed lower end portion 722 that is adapted to abut against the floor of the concrete structure. A spring member 73 is interposed between the second portion 622 of the base plate 62 and the lower end portion 722 of the inclined support 72. A threaded regulating shank 74 extends threadedly through the first section 711 of the pivot plate 71 and has a tip portion 741 abutting against the first portion 621 of the base plate 62 to regulate compression of the spring member 73 and inclination of the pivot plate 71 and the inclined support 72.

The operating member 80 includes a threaded shank 81 which has a lower section that extends threadedly into the axial hole 51 of the tubular seat 50 via the internally threaded sleeve 52 and that is coupled rotatably to the upper end of the rotary shaft 60.

Figure 9:
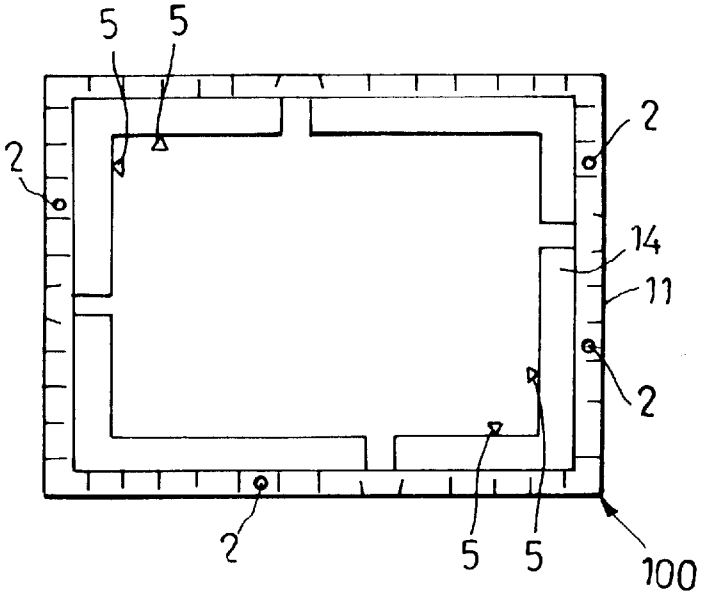
FIG. 9 illustrates the relative positions of the roller assemblies and a member of the pushing apparatus of the preferred embodiment when installed on the conventional wall form assembly of FIGS. 1 and 2.
Figure 10:
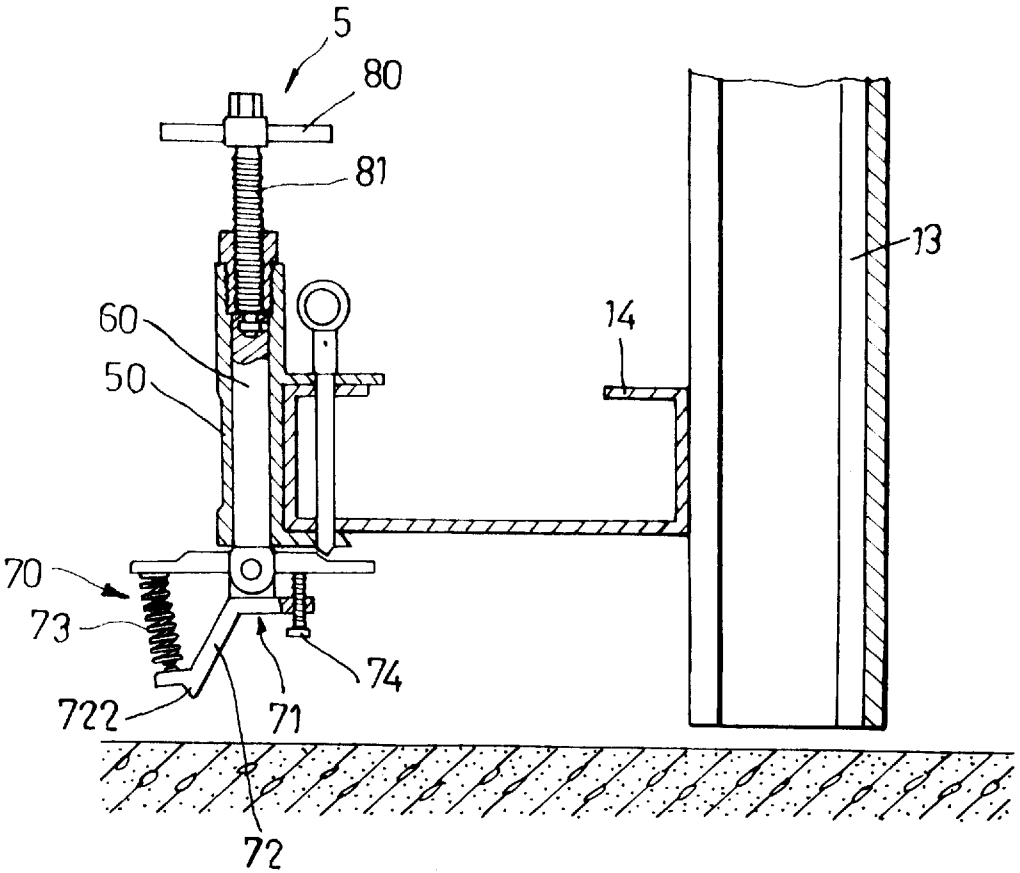
FIG. 10 is a vertical sectional view of the pushing apparatus of the preferred embodiment before the pushing apparatus is operated for pushing the wall form assembly.

Referring to FIG. 9, in use, four sets of roller assemblies 2 are mounted respectively on selected ones of the reinforcement members 14 of the wall form assemblies 1 that have been assembled into a rectangular frame unit 100. Typically, four sets of the pushing apparatuses 5 are mounted at opposite corner portions of the rectangular unit 100 for pushing the rectangular frame unit 100. The operating members 40 of the roller assemblies 2 (see FIG. 4) are operated so as to raise the rectangular frame unit 100 above from the floor of the concrete structure, as shown in FIG. 10. The operating member 80 of a selected one of the pushing apparatuses 5 of the present embodiment is operated so that the rotary shaft 60 moves downward and the lower end portion 722 of the inclined support 72 contacts the floor. When the operating member 80 is continuously operated to rotate the threaded shank 81 so as to extend a longer length of the rotary shaft 60 out of the tubular seat 50, the foot unit 70 is forced toward the floor. As such, the spring member 73 is compressed, and the inclined support 72 is moved pivotally together with the pivot plate 71. Since the lower end portion 722 of the inclined support 72 abuts against the floor, a pushing force is applied by the tubular seat 50 on said one of the reinforcement members 14 to move the wall form assemblies along the direction, as shown in FIG. 7.

If necessary, the regulating shank 74 can be operated to regulate resistance of the spring member 73 so as to adjust inclination of the pivot plate 71 and the inclined support 72 as desired.

It is noted that the rotary shaft 60 is disposed rotatably in the tubular seat 50. The direction of the inclined support 72 can be adjusted in a 360° range to apply a pushing force to the wall form assemblies 1 in all directions.

With this invention thus explained, it is apparent that numerous modifications and variations can be made without departing from the scope and spirit of this invention. It is therefore intended that this invention be limited only as indicated in the appended claims.

I claim:

1. A pushing apparatus for pushing a wall form assembly when moving the wall form assembly on a floor of a concrete structure, the wall form assembly including a plurality of vertical channel pieces coupled detachably side by side to one another, and a plurality of horizontal reinforcement members interconnected detachably to each other, each of the reinforcement members having opposite top and bottom sides, a mounting side which is mounted detachably on the vertical channel pieces, and a free side opposite to the mounting side, the wall form assembly further including a plurality of roller assemblies mounted on the reinforcement members to facilitate adjustment of a position of the wall form assembly on the floor, said pushing apparatus comprising:

an upright tubular seat adapted to be disposed beside the free side of one of the reinforcement members, said tubular seat having upper and lower portions and confining an axial hole through said upper and lower portion, said upper portion having an internally threaded top section and being provided with an upper clamping plate, said lower portion being provided with a lower clamping plate, said upper and lower clamping plates being adapted to abut respectively against the top and bottom sides of said one of the reinforcement members so as to clamp cooperatively said one of the reinforcement members at the free side thereof;

a rotary shaft disposed rotatably in said axial hole of said tubular seat, said shaft having an upper end and a lower end that extends out of said tubular seat and that has a base plate mounted securely thereon, said base plate having a first portion adjacent to said lower clamping plate and a second portion opposite to said first portion;

a foot unit including: a generally horizontal pivot plate disposed below and mounted pivotally to said base plate about a horizontal axis, said pivot plate having a first section adjacent to said first portion of said base plate and a second section opposite to said first section; an inclined support inclining downwardly from said second section of said pivot plate in a direction away from said first section of said pivot plate, said inclined support having a lower end portion that is adapted to contact the floor of the concrete structure; and a spring member interposed between said second portion of said base plate and said inclined support; and an operating member including a threaded shank which has a lower section that extends threadedly into said axial hole of said tubular seat via said internally threaded top section of said upper portion and that is coupled rotatably to said upper end of said shaft;

whereby, when said threaded shank is rotated so as to extend a longer length of said shaft out of said tubular seat, said foot unit is forced toward the floor against action of said spring member and pivots so as to generate a pushing force that is applied by said tubular seat on said one of the reinforcing members to facilitate adjustment of the position of the wall form assembly on the floor.

2. The pushing apparatus of claim 1, further comprising a fastening pin which is adapted to extend removably through said upper and lower clamping plates and said one of the reinforcement members for securing removably said one of the reinforcement members on said tubular seat.

3. The pushing apparatus of claim 1, wherein said foot unit further includes a regulating shank which extends threadedly through said first section of said pivot plate and which has a tip that abuts against said base plate to regulate compression of said spring member and inclination of said pivot plate and said inclined support.

* * * * *